US006651571B2

(12) United States Patent
Bennett et al.

(10) Patent No.: US 6,651,571 B2
(45) Date of Patent: Nov. 25, 2003

(54) INLINE NEEDLE TUFTING MACHINE WITH NEEDLE MODULES

(75) Inventors: Neale Bennett, Lancashire (GB); Gary Crossley, Lancashire (GB)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

(21) Appl. No.: 10/128,028

(22) Filed: Apr. 22, 2002

(65) Prior Publication Data

US 2003/0159634 A1 Aug. 28, 2003

(30) Foreign Application Priority Data

Feb. 22, 2002 (GB) ..... 0204204

(51) Int. Cl.[7] ..... D05C 15/10
(52) U.S. Cl. ..... 112/80.43
(58) Field of Search ..... 112/80.44, 80.4, 112/80.43, 80.45

(56) References Cited

U.S. PATENT DOCUMENTS 3,978,800 A * 9/1976 Card et al. ..... 112/80.43
4,637,329 A 1/1987 Czelusniak, Jr. ..... 112/80.45
4,790,252 A 12/1988 Bardsley ..... 112/80.4
4,815,402 A 3/1989 Price ..... 112/80.44
4,831,948 A 5/1989 Itoh et al. ..... 112/80.43
5,143,003 A * 9/1992 Dedmon ..... 112/80.43
5,566,630 A 10/1996 Burgess et al. ..... 112/80.41

FOREIGN PATENT DOCUMENTS

DE 195 28 148 8/1996 ..... D05C/15/20

* cited by examiner

*Primary Examiner*—Ismael Izaguirre
(74) *Attorney, Agent, or Firm*—Alan Ruderman; Stephen J. Stark

(57) ABSTRACT

A tufting machine configured to provide needles co-linearly along a tufting plane from opposing needle holders provided in a needle module. The needle holders may be selectively latched with latch pins connected to limbs extending from a yoke connected to the push rod of the tufting machine. The needle holders are biased in a dis-engaged position with compression springs which extend between caps on the needle holders and a guide plate which locates the needle holders laterally while spacing the opposed needle holders from one another.

19 Claims, 4 Drawing Sheets

INLINE NEEDLE TUFTING MACHINE WITH NEEDLE MODULES

BACKGROUND OF THE INVENTION

The present invention relates to tufting machines and more particularly to a tufting machine wherein the needles are selectively engageable and are carried in needle modules characterized by opposing pairs of needle holders which retain needles in an in-line, or linear arrangement.

Tufting machines which produce carpet typically include a large frame having a head within which a rotatable mainshaft is mounted and from which needle driving structure is supported for reciprocation of a multiplicity of needles. The frame also includes a bed within which oscillating loopers or hooks are mounted for cooperating with the needles to form loops of yarn, knives being used in conjunction with the hooks to cut the loops in many tufting machines.

As the tufting art has developed, there have been a substantial number of innovations to obtain unique patterning effects. One such innovation has been to shift the needles laterally in accordance with a pattern. Another innovation has been to provide each needle with a sew/no-sew capability by mounting the needles on individual needle holders which are reciprocated selectively by either being latched to or disengaged from a reciprocating latch bar, the latter being reciprocably driven continuously from mechanism driven by the rotating mainshaft. When latched to the latch bar, the needle reciprocates into cooperation with the hook to form a loop. The latching occurs by means of latch pins on pneumatic cylinders driven in accordance with a pattern. Machines of this type are known as controlled needle machines, and when each needle is individually controlled in this manner, it is known as an individually controlled needle machine.

A significant development in the tufting art was to combine the individual controlled needle machine concept with the shifting needle concept, and to feed the backing material intermittently. This provides a tufting machine wherein the needles may be threaded with a number of different yarns, e.g., yams of different colors, and a needle having a yarn of a particular color may be inserted into the backing at any of a selected number of locations so that precise multi-color patterns may be produced similar to the fine woven carpets produced by looms. A machine of this type is illustrated in Bardsley, U.S. Pat. No. 5,653,184.

Over the years, a number of improvements have been made to this design. Specifically, Bardsley, U.S. Pat. No. 5,974,991 provided an improvement to tufting machines to provide needle holders which are individually latched to a reciprocating drive bar and include externally mounted springs, each spring biasing a ratchet clamp which provides for sew/no-sew capability for respective needles Other tufting machine designs apart from individually controlled needle machines have employed opposing pairs of needle holders including Bardsley, U.S. Pat. No. 4,790,252 and Price, U.S. Pat. No. 4,815,402. The '252 patent allowed for only one, or the other, of the needle holders to be operated at by a particular push rod. This allowed for opposing needles to have different type yarns to create unique patterning effects. However, it was not possible to operate both pairs of opposing needle holders at the same time.

The '402 patent discloses that opposing pairs of needles may be moved simultaneously, but does not teach the orientation of opposing pairs of needles in a single linear relationship. Furthermore, the '402 patent does not contemplate opposing needle holders to be constructed in an easily replaceable needle module or modules.

Along with efforts to create unique patterning effects, an increase in detail has been desired. One way to increase the detail of the patterning effects is to decrease the gauge, i.e., the average distance between needle centerlines across the tufting machine. Although it appears that one would only need to reduce the diameter of the needles themselves and/or the thickness of the needle holders to decrease the gauge, this unfortunately weakens these components and increases their failure rate.

The '402 patent teaches one way of decreasing the gauge of tufting machines, but improvements to this basic design are necessary in many applications. For instance, the '402 patent contemplates two parallel and spaced apart rows of needles. The gauge on either of the two rows is half the gauge of the asserted gauge of the machine. The finer gauge is achieved as a result of staggered needles, not a single row of needles. While staggered needles may be satisfactory for some applications, tails of yarn formed by start up of needles in front row of needles are sewn through by rear needles. This is not desirable.

SUMMARY OF THE INVENTION

Consequently, it is a primary object of the present invention to provide a tufting machine having opposing needle modules providing a single row of needles arranged in a linear relationship.

It is another object of the invention to provide a needle module having two or more needle holders connected by guide plates to a mounting block adapted to be secured within a tufting machine.

It is a further object of the present invention to provide a needle module which supports two or more needle holders and a mounting block adapted to be secured within a tufting machine.

It is still a further object of the invention to provide a tufting machine with roughly half the gauge of adjacent needle holders.

Accordingly, the present invention provides a tufting machine having opposing sets of needle holders connected together in the form of needle modules. This configuration provides increased rigidity to the needle holders and is believed to speed the replacement of spent parts. The needle holders are preferably offset one from the other so that the gauge of the needle module may be half the gauge of either of the sets of opposing needle holders. Furthermore the needles from the opposing sets of needle holders are preferably arranged in a single linear relationship relative to one another.

Not only do needle holders gain stability from being connected to opposing needle holders, but the mounting block preferably connects the needle module to a post for lateral stability of the needle module. The connection to the post may allow for up and down adjustment of the needle module, while retaining the mounting block in a fixed position during operation of any of the individual needle holders.

BRIEF DESCRIPTION OF THE DRAWINGS

The particular features and advantages of the invention as well as other objects will become apparent from the follow ing description taken in connection with the accompanying drawings in which.

DESCRIPTION OF THE PREFERRED EMBODIMENT

In most senses, the tufting machine to which the present invention is applicable has a conventional construction. Thus, a detailed explanation of the workings of the machine will not be provided here.

Figure 1:
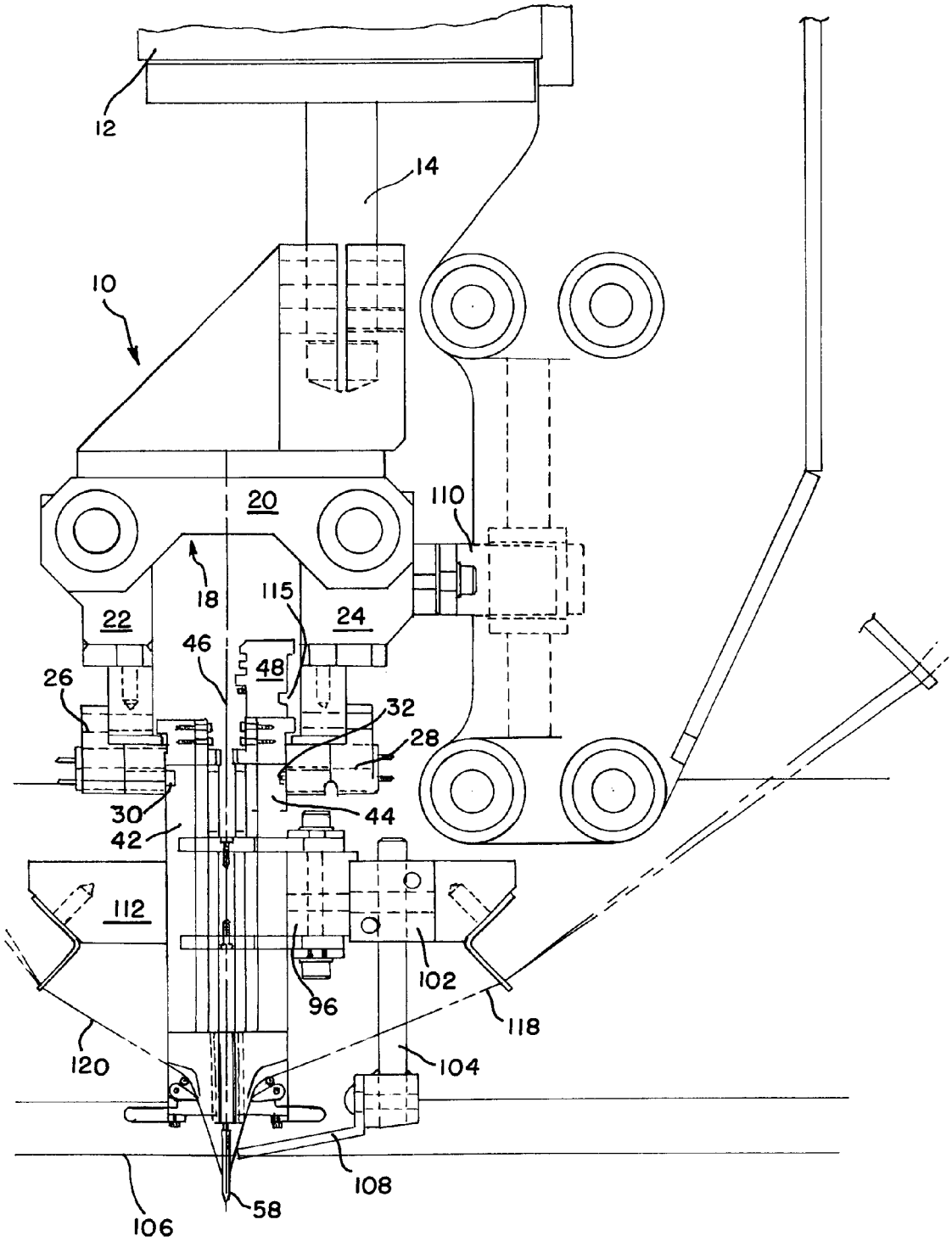
FIG. 1 is a fragmentary vertical cross section view taken substantially through a tufting machine constructed in accordance with the principles of the present invention.

The tufting machine 10 has a head 12 within which is mounted a conventional drive mechanism for reciprocably driving a plurality of laterally spaced push rods 14, one of which is illustrated in FIG. 1. The lateral direction is defined as transverse relative to the longitudinal direction in which a base material is being fed through the machine from the front to the rear thereof, as hereinafter described. The details of the drive mechanism within the head are not required for a disclosure of the present invention, but may be obtained from the disclosure in U.S. Patent No. 3,881,432 among others.

Adjacent the lower end of each push rod 14 is a yoke 18 somewhat similar to the yoke utilized in U.S. Pat. No. 4,815,402. The yoke 18 has a spanning member 20 secured to the push rod 14, and a pair of downwardly depending limbs 22,24 spaced apart in the direction from front to rear of the machine. A laterally elongated latch carrying bar 26 having a substantially L-shaped cross section configuration is connected to the lower end of the limb or limbs 22 while a similar latch carrying bar 28 is connected to the lower end of the limb or limbs 24. The latch carrying bars 26,28 have latch pins 30,32 which may be extended from within the latch carrying bars 26,28 as shown in FIG. 1 in a similar manner as described in the '402 patent to selectively move individual needle holders 42,44 up and down as described in further detail below.

Figure 2:
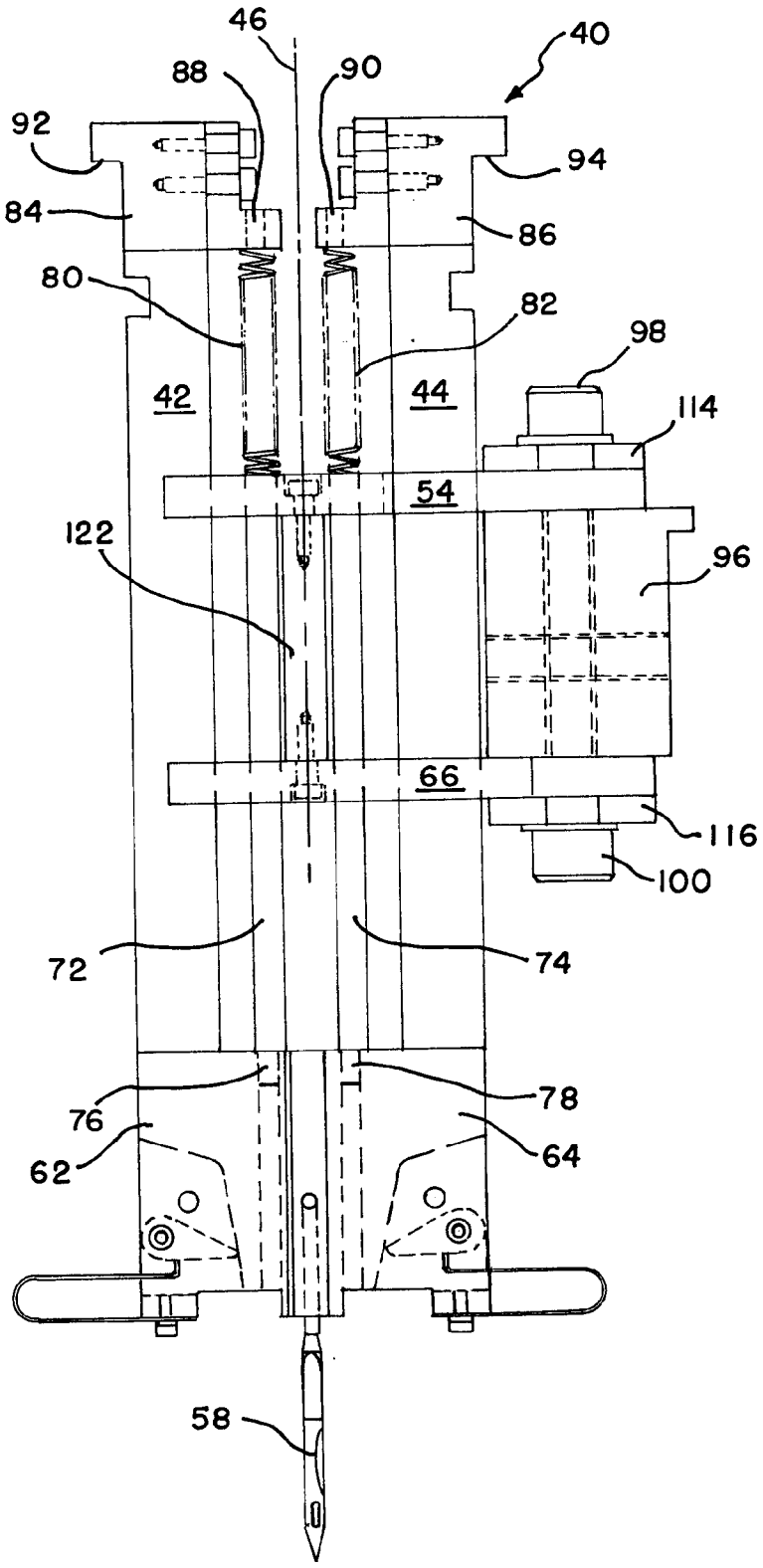
FIG. 2 is a fragmentary vertical cross section view taken substantially through a needle module shown in the tufting machine of FIG. 1.

The needle module 40 is shown in FIG. 2. The needle module 40 is comprised of at least two, and preferably more needle holders 42,44 which are on opposing sides of tufting axis 46. FIG. 1 shows at least three needle holders 42,44,48 while FIG. 3 contemplates each needle module 40 having thirty five needle holders 42,44 disposed one per slot 50 or slot 52 in the guide plates 54,66. Needle holder 42 is one of a set that opposes needle holder 44,48 about the tufting axis 46.

Figure 4:
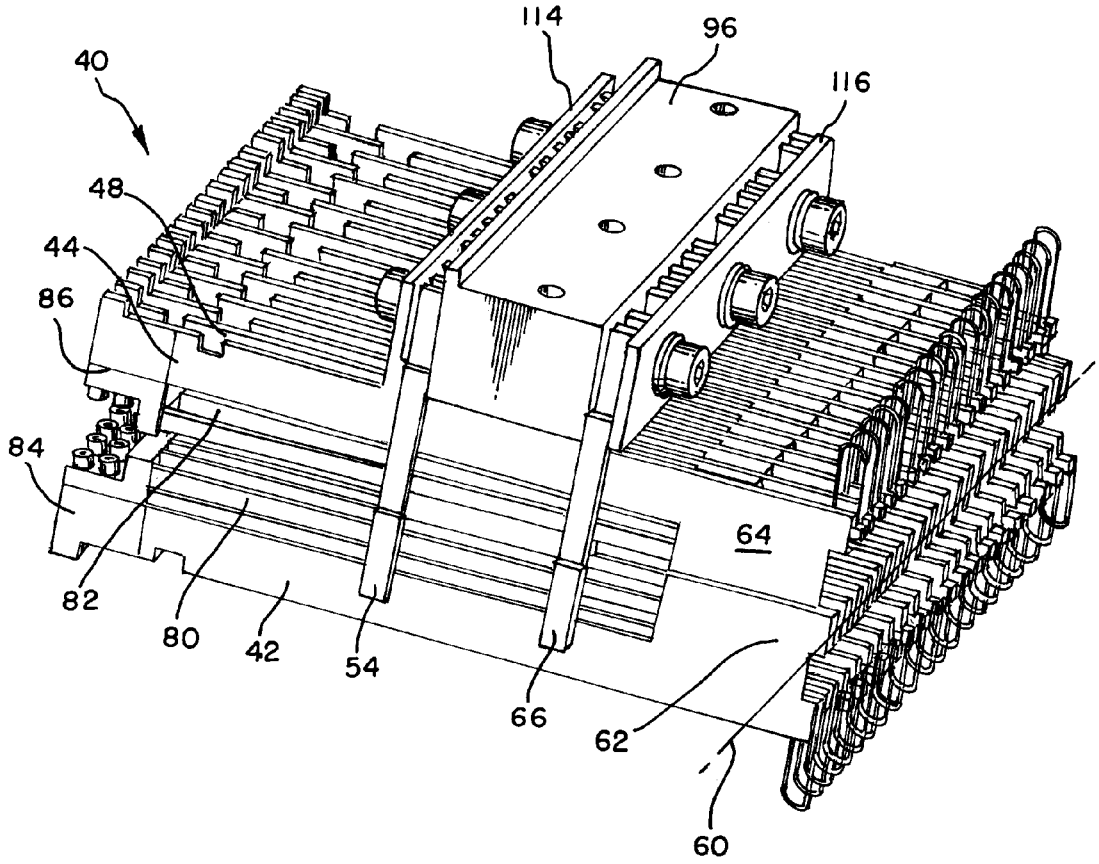
FIG. 4 is an elevational perspective view of the needle module shown in FIG. 2.

FIG. 2 shows the needle module 40 comprised of a plurality of needle holders 42,44 which are connected to needles 58. Tufting axis 46 is perpendicular to the tufting row 60, shown in FIG. 4, to create a tufting plane wherein the needles 58 are substantially co-linear. As can be seen in FIG. 4, opposing needle holders 42,44 are constructed to overlap along base portions 62,64 so that the needles 58 may be arranged in a co-linear relationship.

Referring back to FIG. 2, one or more guide plates 54,66 are utilized to provide lateral support to the needle holders 42,44 while allowing the needle holders to move up and down within slots 50,52 in the guide plate.

Figure 3:
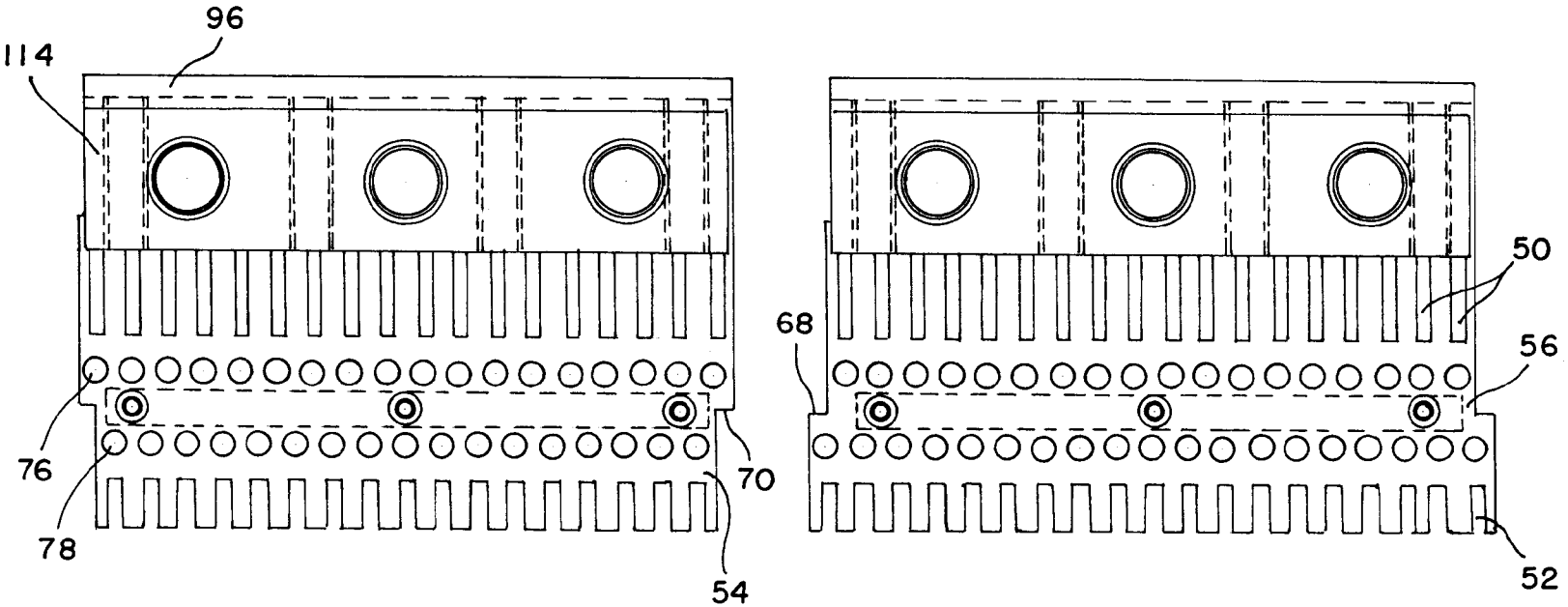
FIG. 3 is a top view of a portion of the needle module shown in FIG. 2, namely the mounting block connected to guide plates, the needle holders and spring rods have been removed.

The guide plates 54,66 shown in FIG. 3 are configured to work adjacent to one another such as containing a plurality of needle holders 42 and 44. The guide plates have interfitting edges 68,70 which cooperate with one another to allow there to be no decrease in gauge where the adjacent guide plates 54,66 contact one another. The guide plates 54,66 are also preferably machined so that slots 50 substantially surround at least three sides of a needle module, while slots 52 may or may not be as encompassing as slots 50 are illustrated.

In order to assemble a needle module 40, the needle holders 42,44, are fitted with needles 58 and placed in the slots 50,52 of the guide plates 54,66. Rods 72,74 are then placed through bores 76,78 in the base 62,64 of the needle holder. The rods 72,74 have compression spring members 80,82. The compression spring members 80,82 allow for the spring members 80,82 and/or rods 72,74 to connect into caps 84,86 on the needle holder 42,44 by compressing the members 80,82 and inserting the rods 72,74. The caps 84,86 have bores 88,90 which receive one of the spring members 80,82 or rods 72,74. The caps 84,86 may be integral to the needle holder 42 or 44 or may connected thereto. The caps 84,86 or other portion of needle holder 42 or 44 may have ledges 92,94 which limit the travel of the needle holder 42 or 44 relative to the latch carrying bars 26,28 illustrated in FIG. 1 or other portions of the limbs 22,24 in a vertical direction. These ledges 92,94 may also assist in returning the needle holders 46,48 to top on release of latch pin 30,32.

The guide plates 54,66 are connected to a mounting bar 96 such as with bolts 98,100 or otherwise. The mounting block arrangement provides horizontal stability to the needle holders 42,44 and thus to the needles 58 during tufting operation.

In prior art constructions, such as illustrated in FIG. 1 of U.S. Pat. No. 5,974,991, the only additional horizontal stability was provided by arm 26. While this improvement is also present as arm 110, it has been found that horizontal stability closer to the needles 58 is also advantageous. Guide 112 may also provide some horizontal stability for needle modules 42 and thus for the needle module 40.

FIG. 3 show detail concerning the mounting block 96 and top plate 114 which is held by bolt 98 into mounting block 96. Bottom plate 116 is utilized in a similar manner with bolt 100 to secure the guide plates 54,66 there between. The guide plates 54,66 are substantially parallel to one another and connected at spaced apart portions on the mounting block 96.

FIG. 1 illustrates the operation of the tufting machine 10. During operation the push rod 14 reciprocates up and down, thereby driving yoke 18 and limbs 22,24 up and down. The plurality of latch pins 30,32 are preferably individually controlled in order to tuft a desired pattern onto the backing 106. When the latch pins 30,32 are extended into receivers, illustrated as channels 115, of the needle holders 42,44 the needles 58 connected to the latched needle holders 42,44 are driven through the backing with yarn 118,120.

If a particular needle holder 48 is not latched in its respective channel 115 during the downward stroke of the push rod 14, the respective needle 58 carried by the needle holder 48 is not driven through the backing 106 for that particular stroke of the push rod 14. Needle holders 42,44 have been latched, needle holder 48 has not been latched.

The mechanics of the needle module 40 during operation may be better understood by examining the enlarged illustrations in FIGS. 2 and 4. FIG. 2 shows needle holders 42,44 in a down position relative to the guide plates 54,66, as well as the mounting bar 96. The compression member 80,82 are at least partially compressed and the position would result in the needles 58 being driven through the backing (not shown in this Figure); this is an engaged position since the spring members 80,82 would be more compressed than when disengaged as shown by needle holder 48 in FIG. 1. FIG. 4 shows needle modules 42,44 in an up position relative to the guide plates 54,66, and the mounting bar 96. The spring members 80,82 are not as compressed in FIG. 4 as they are in FIG. 2. Note how the mounting bar 96 and guide plates 54,66 are lower in FIG. 4 than in FIG. 2. The spring members 80,82 in FIG. 4 preferably are still under some compression so that the rods 72,74 are retained relative to the needle holders 42,44 since the rods 72,74 assist in maintaining the needle holders 42,44 in position relative to the guide plates 54,66 and thus the mounting block 96.

As specific needle holders 42,44 are latched and driven to tuft, these particular needle holders 42,44 are driven downwardly while the guide plates 54,66, the mounting bar 96, and the needle holders 48 not latched remain stationary. In the latched needle holders 42,44, the spring members 80,82 are compressed and the needle holders 42,44 continue through the downward stroke of the push rod 14. On the upward stroke of the push rod 14, the needle holders 42,44 may be unlatched or continue to be latched for another stitch. A bridge plate 122 may add to the stability of the guide plates 54,66 and thus to the needle module 40.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A needle module for use with a tufting machine comprising:

first and second needle holders having a base portion connected to a needle;

a first guide plate locating the first and second needle holders laterally in spaced apart relationship, the first needle holders being substantially parallel to one another, the second needle holders being substantially parallel to one another; and a mounting block secured to the first guide plate and adapted to be secured within the tufting machine;

each of said first and second needle holders moveable between an engaged and a dis-engaged position relative to the first guide plate, said first and second needle holders normally biased in the dis-engaged position by spring members intermediate the respective first and second needle holders and the first guide plate.

2. The needle module of claim 1 wherein said guide plate having a plurality of slots, each of said plurality of slots providing a passage for the movement of one of the first and second needle holders to move between the engaged and dis-engaged position.

3. The needle module of claim 1 wherein the first and second needle holders have caps located above the base portion, and the compression spring members are located between the caps and the first guide plate.

4. A needle module for use with a tufting machine comprising:

first and second needle holders having a base portion connected to a needle;

a first guide plate locating the first and second needle holders laterally in spaced apart relationship, the first needle holders being substantially parallel to one another, the second needle holders being substantially parallel to one another, the first guide plate including bores extending there through, rods extending through the bores and into the base portion, said rods securing the first and second needle holders laterally relative to said first guide plate while allowing up and down movement between the engaged and dis-engaged positions; and a mounting block secured to the first guide plate and adapted to be secured within the tufting machine;

each of said first and second needle holders moveable between an engaged and a dis-engaged position relative to the first guide plate, said first and second needle holders normally biased in the dis-engaged position by compression spring members.

5. The needle module of claim 4 wherein said needles define a tufting row extending through all needles, and the bores are located closer to the tufting row than the slots.

6. The needle module of claim 1 further comprising a second guide plate parallel to the first guide plate and secured to the mounting block.

7. The needle module of claim 6 wherein the guide plates connect to spaced apart portions of the mounting block.

8. The needle module of claim 1 wherein the needles connected to both the first and second needle holders are coplanar along a plane defined by a tufting row and an axis along which the needles tuft.

9. A needle module for a tufting machine comprising:

a plurality of first and second needle holders, each first and second needle holders having a base portion connected to a needle;

a first guide plate locating at least portions of the plurality of first and second needle holders opposite one another relative to a tufting plane defined therebetween; and a mounting block secured to said first guide plate for supporting said plurality of first and second needle holders and first guide plate as a unit;

said plurality of first and second needle holders moveable between an engaged and a dis-engaged position relative to the first guide plate, said first and second needle holders locating their respective needles along the tufting plane.

10. The needle module of claim 9 wherein the first guide plate has an interfacing edge adapted to cooperate with an adjacent guide plate of an adjacent needle module in said tufting machine while maintaining a predetermined gauge between needles operable between the first and second guide plates.

11. The needle module of claim 9 further comprising compression spring members connected to the first and second needle holders.

12. The needle module of claim 11 further comprising caps connected to the first and second needle holders and the compression spring members are located between the caps and the first guide plate.

13. A needle module for a tufting machine comprising:

first and second needle holders, each first and second needle holders having a base portion connected to a needle;

a first guide plate locating at least portions of the first and second needle holders laterally opposite one another relative to a tufting plane defined therebetween;

a mounting block secured to said first guide plate for supporting said first and second needle holders and first guide plate as a unit;

said first and second needle holders moveable between an engaged and a dis-engaged position relative to the first guide plate, said first and second needle holders locating their respective needles along the tufting plane;

compression spring members connected to the first and second needle holders; and caps connected to the first and second needle holders with the compression spring members located between the caps and the first guide plate;

wherein the first guide plate further comprises bores, and further comprising rods extending between the caps and the base portions through the bores to restrict lateral movement of the first and second needle holders while allowing up and down movement between the engaged and disengaged position, and compression spring members which compress upon application of force to allow the needle holders to move up and down relative to the first guide plate.

14. The needle module of claim 13 wherein the compression spring members are located between the first guide plate and the caps.

15. The needle module of claim 13 in combination with a tufting machine comprising:

a head for mounting drive means including a push rod reciprocating in a linear path;

a bed disposed beneath the head having means for supporting a backing material fed in a longitudinal direction normal to said path;

a yoke connected to the push rod driving opposing limbs on either side of a tufting axis; and selectively operable latches connected to the limbs, each of said latches configured to operably connect with one of the first and second needle holders.

16. A tufting machine comprising:

a head for mounting drive means including a push rod reciprocating in a linear path;

a bed disposed beneath the head having means for supporting a backing material fed in a longitudinal direction normal to said path;

a yoke connected to the push rod driving opposing limbs on either side of a tufting plane;

a first needle module having first and second needle holders, said first needle holders opposing said second needle holders on opposing sides of the tufting plane, said first and second needle holders connected to needles, said needle module locating said needles of both said first and second needle holders in the tufting plane; and selectively operable latches connected to the limbs, each of said latches configured to operably connect with one of the first and second needle holders.

17. The tufting machine of claim 16 further comprising a second needle module adjacent to the first needle module wherein the first and second needle modules have interfacing edges which cooperate with one another to provide a consistent gauge from a first end of the first needle module to an opposite end of the second needle module.

18. The tufting machine of claim 17 wherein the first needle module further comprises caps connected to the first and second needle modules and compression springs located between the caps and the first guide plate, said compression springs biasing the first and second needle holders in a disengaged position.

19. The tufting machine of claim 18 wherein the latching of one of a first and second needle holder during a down stroke of the push rod places the one of the first and second needle holders in an engaged position.

* * * * *